United States Patent [19]

Cowles

[11] 4,335,693

[45] Jun. 22, 1982

[54] FUEL INJECTION APPARATUS AND SYSTEM

[75] Inventor: Warren H. Cowles, Bloomfield Hills, Mich.

[73] Assignee: Colt Industries Operating Corp., New York, N.Y.

[21] Appl. No.: 76,964

[22] Filed: Sep. 20, 1979

[51] Int. Cl.[3] ..... F02B 33/00; F02M 7/00

[52] U.S. Cl. ..... 123/438; 123/585; 123/586; 123/587; 261/78 R; 261/50 A

[58] Field of Search ..... 123/437, 438, 440, 472, 123/585, 586; 261/78 R, 50 A

[56] References Cited

U.S. PATENT DOCUMENTS

| | | | |
|---|---|---|---|
| 1,275,032 | 8/1918 | Huene | 123/119 R |
| 3,931,814 | 8/1976 | Rivere | 123/119 R |
| 4,132,203 | 1/1979 | Elpern | 123/139 AW |

OTHER PUBLICATIONS

"Basic Carburetion/Fuel Systems", vol. #3, 1971, Petersen Publishing Co., p. 31.

*Primary Examiner*—Ronald B. Cox

*Attorney, Agent, or Firm*—Walter Potoroka, Sr.

[57] ABSTRACT

A fuel metering apparatus is shown as having a throttle body with induction passage means therethrough and a throttle valve for controlling flow through the induction passage means, fuel under superatmospheric pressure is metered and such metered fuel is supplied to a fuel discharge nozzle situated within the induction passage means downstream of the throttle valve; a first air flow is supplied to the metered fuel upstream of the fuel discharge nozzle as to cause the metered fuel to at least start to undergo atomization even before being discharged at the discharge nozzle; a second air flow is also supplied to the fuel discharge nozzle as to at idle engine speed flow sonically therethrough, and additional throttling valving means are provided for controlling the air flow to the fuel discharge nozzle.

49 Claims, 5 Drawing Figures

FUEL INJECTION APPARATUS AND SYSTEM

FIELD OF INVENTION

This invention relates generally to fuel injection systems and more particularly to fuel injection systems and apparatus for metering fuel flow to an associated combustion engine.

BACKGROUND OF THE INVENTION

Even though the automotive industry has over the years, if for no other reason than seeking competitive advantages, continually exerted efforts to increase the fuel economy of automotive engines, the gains continually realized thereby have been deemed by various levels of government as being insufficient. Further, such levels of government have also arbitrarily imposed regulations specifying the maximum permissible amounts of carbon monoxide (CO), hydrocarbons (HC) and oxides of nitrogen ($NO_x$) which may be emitted by the engine exhaust gases into the atmosphere.

Unfortunately, generally, the available technology employable in attempting to attain increases in engine fuel economy is contrary to that technology employable in attempting to meet the governmentally imposed standards on exhaust emissions.

For example, the prior art in trying to meet the standards for $NO_x$ emissions has employed a system of exhaust gas recirculation whereby at least a portion of the exhaust gas is reintroduced into the cylinder combustion chamber to thereby lower the combustion temperature therein and consequently reduce the formation of $NO_x$.

The prior art has also proposed the use of engine crankcase recirculation means whereby the vapors which might otherwise become vented to the atmosphere are introduced into the engine combustion chambers for further burning.

The prior art has also proposed the use of fuel metering means which are effective for metering a relatively overly rich (in terms of fuel) fuel-air mixture to the engine combustion chamber means as to thereby reduce the creation of $NO_x$ within the combustion chamber. The use of such overly rich fuel-air mixtures results in a substantial increase in CO and HC in the engine exhaust which, in turn, requires the supplying of additional oxygen, as by an associated air pump, to such engine exhaust in order to complete the oxidation of the CO and HC prior to its delivery into the atmosphere.

The prior art has also heretofore proposed employing the retarding of the engine ignition timing as a further means for reducing the creation of $NO_x$. Also, lower engine compression ratios have been employed in order to lower the resulting combustion temperature within the engine combustion chamber and thereby reduce the creation of $NO_x$. In this connection the prior art has employed what is generally known as a dual bed catalyst. That is, a chemically reducing first catalyst is situated in the stream of exhaust gases at a location generally nearer the engine while a chemically oxidizing second catalyst is situated in the stream of exhaust gases at a location generally further away from the engine and downstream of the first catalyst. The relatively high concentrations of CO resulting from the overly rich fuel-air mixture are used as the reducing agent for $NO_x$ in the first catalyst while extra air supplied (as by an associated pump) to the stream of exhaust gases, at a location generally between the two catalysts, serves as the oxidizing agent in the second catalyst. Such systems have been found to have various objections in that, for example, they are comparatively very costly requiring additional conduitry, air pump means and an extra catalyst bed. Further, in such systems, there is a tendency to form ammonia which, in turn, may or may not be reconverted to $NO_x$ in the oxidizing catalyst bed.

The prior art has also proposed the use of fuel metering injection means for eliminating the usually employed carbureting apparatus and, under superatmospheric pressure, injecting the fuel through individual nozzles directly into the respective cylinders of a piston type internal combustion engine. Such fuel injection systems, besides being costly, have not proven to be generally successful in that the system is required to provide metered fuel flow over a very wide range of metered fuel flows. Generally, those prior art injection systems which are very accurate at one end of the required range of metered fuel flows, are relatively inaccurate at the opposite end of that same range of metered fuel flows. Also, those prior art injection systems which are made to be accurate in the mid-portion of the required range of metered fuel flows are usually relatively inaccurate at both ends of that same range. The use of feedback means for altering the metering characteristics of such prior art fuel injection systems has not solved the problem of inaccurate metering because the problem usually is intertwined within such factors as: effective aperture area of the injector nozzle; comparative movement required by the associated nozzle pintle or valving member; inertia of the nozzle valving member; and nozzle "cracking" pressure (that being the pressure at which the nozzle opens). As should be apparent, the smaller the rate of metered fuel flow desired, the greater becomes the influence of such factors thereon.

It is now anticipated that the said various levels of government will be establishing even more stringent exhaust emission limits of, for example, 1.0 gram/mile of $NO_x$ (or even less).

The prior art, in view of such anticipated requirements with respect to $NO_x$, has suggested the employment of a "three-way" catalyst, in a single bed, within the stream of exhaust gases as a means of attaining such anticipated exhaust emission limits. Generally, a "three-way" catalyst is a single catalyst, or catalyst mixture, which catalyzes the oxidation of hydrocarbons and carbon monoxide and also the reduction of oxides of nitrogen. It has been discovered that a difficulty with such a "three-way" catalyst system is that if the fuel metering is too rich (in terms of fuel), the $NO_x$ will be reduced effectively but the oxidation of CO will be incomplete; if the fuel metering is too lean, the CO will be effectively oxidized but the reduction of $NO_x$ will be incomplete. Obviously, in order to make such a "three-way" catalyst system operative, it is necessary to have very accurate control over the fuel metering function of associated fuel metering supply means feeding the engine. As hereinbefore described, the prior art has suggested the use of fuel injection means, employing respective nozzles for each engine combustion chamber, with associated feedback means (responsive to selected indicia of engine operating conditions and parameters) intended to continuously alter or modify the metering characteristics of the fuel injection means. However, as also hereinbefore indicated, such fuel injection systems have not proven to be successful.

It has also heretofore been proposed to employ fuel metering means, of a carbureting type, with feedback means responsive to the presence of selected constituents comprising the engine exhaust gases. Such feedback means were employed to modify the action of a main metering rod of a main fuel metering system of a carburetor. However, tests and experience have indicated that such a prior art carburetor and such a related feedback means can never provide the degree of accuracy required in the metering of fuel to an associated engine as to assure meeting, for example, the said anticipated exhaust emission standards.

Accordingly, the invention as disclosed, described and claimed is directed, primarily, to the solution of such and other related and attendant problems of the prior art.

SUMMARY OF THE INVENTION

According to the invention, a fuel metering apparatus and system employs a throttle body with induction passage means therethrough and a throttle valve for controlling flow through the induction passage means, fuel under superatmospheric pressure metered and such metered fuel is supplied to a fuel discharge nozzle situated within the induction passage means downstream of the throttle valve; a first air flow is supplied to the metered fuel upstream of the fuel discharge nozzle as to cause the metered fuel to at least start to undergo atomozation even before being discharged at the discharge nozzle; a second air flow is also supplied to the fuel discharge nozzle as to at idle engine speed flow sonically therethrough, and additional throttling valving means are provided for controlling the air flow to the fuel discharge nozzle.

Various general and specific objects, advantages and aspects of the invention will become apparent when reference is made to the following detailed description considered in conjunction with the accompanying drawings.

BRIEF DESCRIPTION OF THE DRAWINGS

In the drawings wherein for purposes of clarity certain details and/or elements may be omitted.

DETAILED DESCRIPTION OF THE PREFERRED EMBODIMENT

Figure 1:
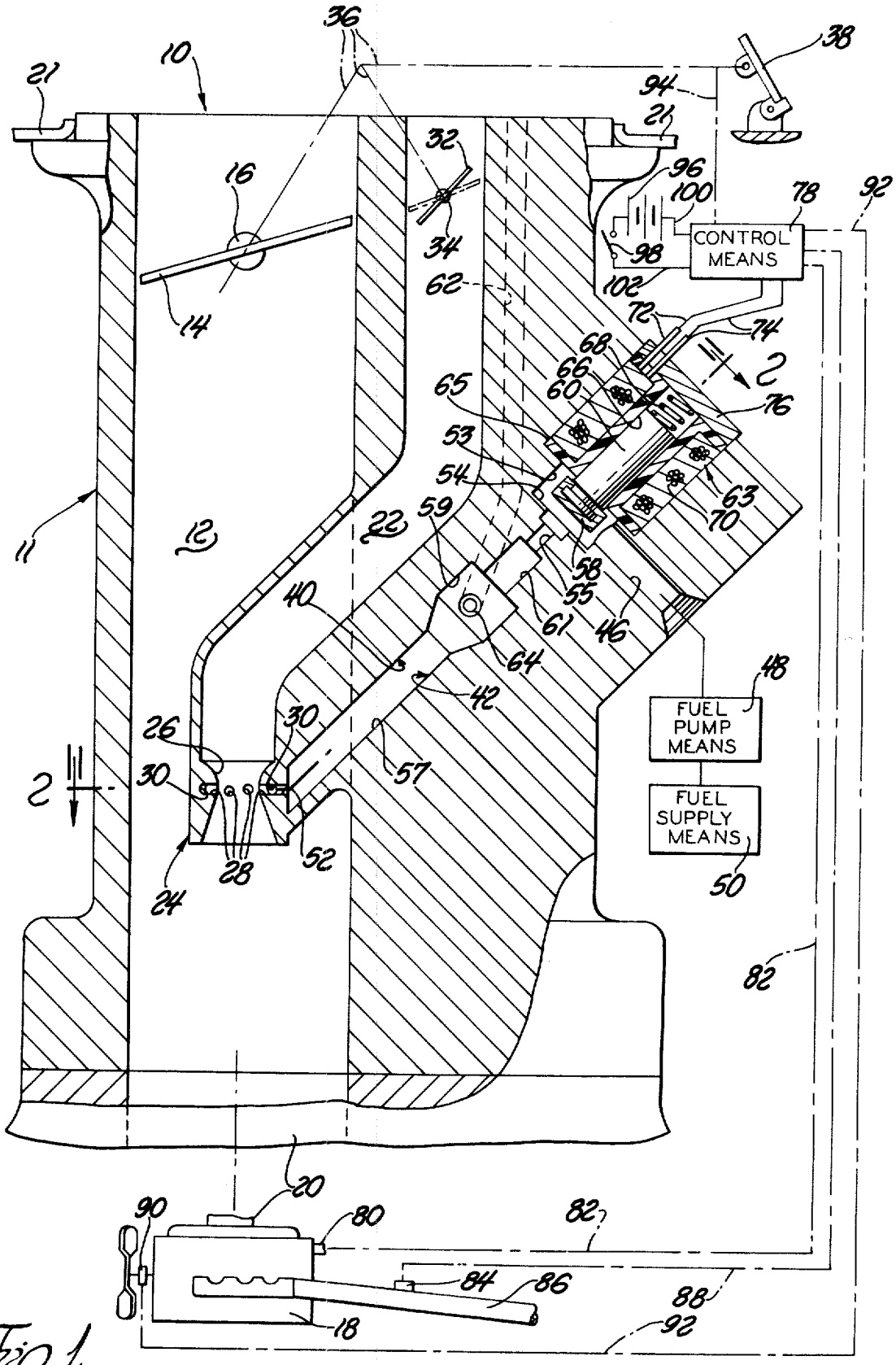
FIG. 1 illustrates in cross-section one form of a fuel injection apparatus and system employing teachings of the invention.

Referring now in greater detail to the drawings, FIG. 1 illustrates fuel injection apparatus and system 10 comprised as of induction body or housing means 11 having main induction passage means 12 wherein a throttle valve 14 is situated and carried as by a rotatable throttle shaft 16 for rotation therewith thereby variably restricting the flow of air through the induction passage means 12 and into the engine 18 as via associated engine intake manifold means 20. If desired, suitable air cleaner means may be provided as to generally emcompass the inlet of induction passage means 12 as generally fragmentarily depicted at 21. Second or separate induction passage means 22 is also provided in housing means 11 as for the passage therethrough of idle engine operation air flow. As depicted, the downstream portion of induction passage means 22 communicates as with fuel discharge nozzle means 24 which preferably comprises a venturi-like fuel atomozing portion 26 provided with fuel discharge port means comprised as of a plurality of discharge ports 28 communicating with an annulus 30. An idle air flow valve 32, situated in auxiliary induction passage 22, may be carried by related rotatable shaft means 34 for pivotal rotation therewith. The throttling valve means 14 and 32 may be suitably operatively interconnected as through related linkage and motion transmitting means 36 to the operator positioned throttle control means which may be the operator foot-operated throttle pedal or lever 38 as usually provided in automotive vehicles.

Fuel supply conduit or passage means 40 may comprise, for example, a first metered fuel passage portion 42 communicating with a second unmetered fuel passage portion 46 leading as to related fuel pumping means 48 which receives its fuel as from associated fuel supply or reservoir means 50. Conduit or passage portion 42 is placed in communication with the discharge orifice means 28 as by suitable conduit means 52 effectively communicating between passage 42 and annulus 30. A valve seating surface 54 formed as within a chamber 53, is effective for cooperating with the valve surface 58 of a valving member 60 for opening and closing communication and flow through a first conduit segment 55. Further, passage means 40, as at a point downstream of chamber 53, is placed in communication with a source of ambient atmosphere as by conduit means 62 comprising calibrated restriction passage means 64.

Valve member 60 is illustrated as comprising a portion of an overall oscillator type valving means or assembly 63 which is depicted as comprising a spool-like bobbin 65 having inner passage means 66 slidably receiving therein valve member 60 and spring means 68 yieldingly urging valve member 60 generally toward the left and into seated engagement with valve seating surface means 54. A field or solenoid winding or coil 70 is carried by the bobbin 65 and has its opposite electrical ends connected as to electrical conductors 72 and 74 which may pass through suitable closure means 76 and be electrically connected as to related control means 78. The practice of the invention is not limited to, for example, a particular fuel metering means; however, in the preferred embodiment, the metering valving means 63 is of the duty-cycle type wherein the winding 70 is intermittently energized thereby causing, during such energization, valve member 60 (which is the armature) to move in a direction away from valve seating surface means 54 to a position as generally depicted. As should be apparent, with such a duty-cycle type metering solenoid assembly the "effective flow area" immediately downstream of valving member surface 58 can be variably and controllably determined by controlling the frequency and/or duration of the energization of coil means 70.

The control means 78 may comprise, for example, suitable electronic logic type control and power output means effective to receive one or more parameter type input signals and in response thereto produce related outputs. For example, engine temperature responsive transducer means 80 may provide a signal via transmission means 82 to control means 78 indicative of the engine temperature; sensor means 84 may sense the relative oxygen content of the engine exhaust gases (as within engine exhaust conduit means 86) and provide a signal indicative thereof via transmission means 88 to control means 78; engine speed responsive transducer means 90 may provide a signal indicative of engine speed via transmission means 92 to control means 78 while engine load, as indicated for example by throttle valve 14 position, may provide a signal as via transmission means 94 to control means 78. A source of electrical potential 96 along with related switch means 98 may be electrically connected as by conductor means 100 and 102 to control means 78.

Figure 2:
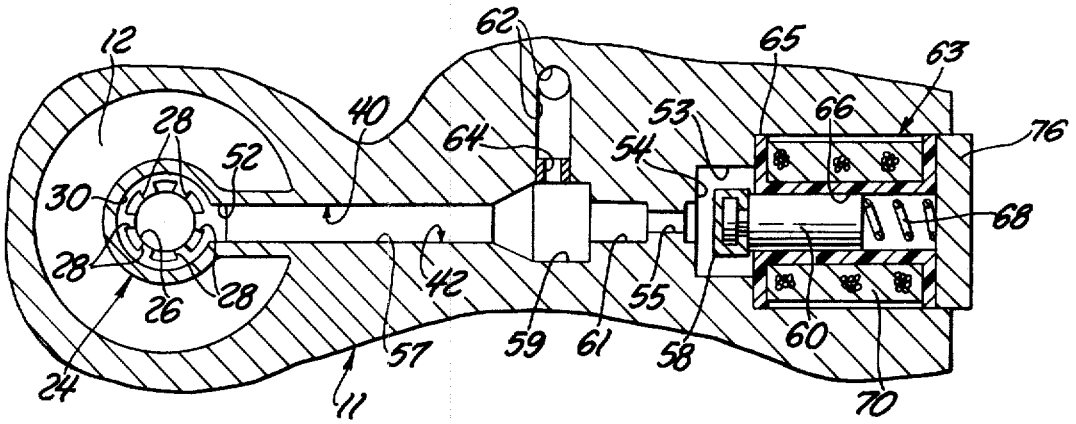
FIG. 2 is a cross-sectional view taken generally on the plane of line 2—2 of FIG. 1 and looking in the direction of the arrows.

Referring to both FIGS. 1 and 2, it can be seen that the metered fuel passage or conduit means 42 is illustrated as comprising calibrated passage means 55 in series with a downstream situated conduit section 57 which preferably comprises an enlarged chamber-like passage portion 59. As depicted, the conduit section 57 may extend upstream of enlarged passage portion 59 as to define, in effect, an extending portion 61 of passage or conduit section 57. As also possibly best shown in FIG. 2, the downstream end of metered fuel conduit section 57 communicates with inlet 52 leading as to the annulus 30 which, in turn, feeds the discharge port means 28.

The bleed air passage means 62, communicating as with the ambient, comprises calibrated restriction means 64 and, in the preferred embodiment such bleed air as is delivered into the metered fuel conduit means 42 is introduced as to have its general path flow generally perpendicular to the general path of flow of the metered fuel. Also, in the preferred embodiment, the general path of flow of such metered fuel, as it leaves the calibrated passage or restriction means 55, is in a straight line path to the nozzle means 24.

Operation of Invention

Generally, in the embodiment disclosed, fuel under regulated, substantially constant, pressure is supplied as by fuel pump means 48 to conduit 46 and chamber 53 from where such fuel is metered by the metering function cooperatively defined by the valving surface 54, movable valve surface 58 and calibrated passage or restriction means 55 from where such metered fuel flows into metered fuel conduit means 42, through inlet passage 52 into annulus 30 and ultimately through discharge port means 28 and to the engine 18. The rate of metered fuel flow, in the embodiment disclosed, will be dependent upon the relative percentage of time, during an arbitrary cycle time or elapsed time, that the valve surface 58 is relatively close to or seated against valve orifice seat 54 as compared to the percentage of time that the valve surface 58 is relatively far away from the cooperating valve orifice seat 54. This, in turn, is dependent on the output to coil 70 from control means 78 which, in turn, is dependent on the various parameter signals received by the control means 78. For example, if the oxygen sensor and transducer means 84 senses the need of a further fuel enrichment in the motive fluid being supplied to the engine and transmits a signal reflective thereof to the control means 78, the control means 78, in turn, will require that the metering valve 60 be opened a greater percentage of time as to provide the necessary increased rate of metered fuel flow. The practice of the invention is not limited to a particular form of fuel metering means or to a particular system for the control of such fuel metering means. Accordingly, it will be understood that given any selected parameters and/or indicia of engine operation and/or ambient conditions, the control means 78 will respond to the signals generated thereby and respond as by providing appropriate energization and de-energization of coil means 70 (causing corresponding movement of valve member 60) thereby achieving the then required metered rate of fuel flow to the engine.

The prior art has employed relatively high pressures both upstream and downstream of the fuel metering means in an attempt to obtain sufficient fuel atomization within the induction passage means. Such have not proven to be successful.

It has been discovered that the invention provides excellent fuel atomization characteristics even when the upstream unmetered fuel pressure is in the order of 5.0 p.s.i. (the prior art often employing upstream unmetered fuel pressures in the order of 40.0 p.s.i.). The invention achieves this, it is believed, by in effect attaining total fuel atomization of the metered fuel, as contrasted to merely a fuel-air emulsification, even before the delivery of such metered fuel to the discharge nozzle means 24. That is, during engine operation the velocity of bleed air flow through the calibrated air bleed restriction means 64 is at sonic condition while the rate of flow of solid (liquid) metered fuel from calibrated means 55 is at a sub-sonic condition. The high velocity bleed-air stream impinges upon and interacts with the lower velocity stream of fuel causing atomization of the fuel at the point of contact of such bleed-air and fuel streams. Such atomization also continues during the subsequent flow downstream of the point of contact so that, in the preferred embodiment, the linear distance, between the discharge aperture means 28 and the point or area where the bleed-air stream and the liquid fuel stream contact and interact, is of substantial length.

As previously generally indicated, in the preferred embodiment, an enlarged chamber-like portion 59 is provided. Such a chamber or enlargement at the initial point of contact between the streams of bleed-air and liquid fuel provides additional space for the initial atomization of the fuel. That is, the increased space provided by the enlargement 59 in effect accommodates, at that point, the increased volume of the resulting air-atomized-fuel stream which is, of course, the product of the volume of the bleed-air stream and the atomized fuel. Further, it is believed that causing the metered liquid fuel to expand (by having it enter the enlargement 59) and causing the bleed-air to also undergo expansion (by having it enter the enlargement 59) further enhances the overall atomization of the fuel. Also, in the preferred embodiment, it is preferred that the discharge end of the calibrated restriction means 64 be situated as to be as close as practically possible to the stream or flow of liquid metered fuel. That is, since the restriction means 64 provides for the sonic flow of bleed air it becomes of value to have the discharge end of such restriction means 64 in such proximity to the stream of liquid metered fuel as to maximize the benefit of such sonic flow and preclude any significant loss of such sonic velocity before the bleed air actually strikes and interacts with the metered liquid fuel. FIG. 2 depicts this concept by illustrating that the discharge end of restriction 64 is, for example, at the side wall of enlargement 59.

The fuel atomization provided by the invention enables the effectively perfect fuel distribution as to a multicombustion chamber engine and achieving this in the entire range of engine operation while only having to employ relatively low pressure unmetered fuel. In the apparatus of FIGS. 1 and 2, during curb idle and a portion of the idle engine operation, the main air throttle means 14 may be generally fully closed while the auxiliary or idle air throttle valve means 32 is partly opened thereby requiring that generally all air-flow to the engine 18 pass through induction passage means 22. Such idle air flow passing through the venturi portion 26 of discharge nozzle means 24 produces a reduced pressure in the area of the fuel discharge port means 28 thereby further assisting in the flow of such atomized metered fuel into the stream of idle air flowing through the nozzle 24. As such fuel-atomized-air mixture passes from the nozzle 24 and into the main induction passage means 12, it undergoes a further and substantial expansion which, in turn, results in a further atomization and distribution of the fuel within the fuel-air mixture prior to its introduction into the engine 18.

As increased idle engine loads are experienced, the idle or auxiliary air throttle valve means 32 is further opened and eventually, with still further increasing engine loads opening of the main air throttle means 14 is initiated. Such, in effect, staged opening of the auxiliary and main air throttle valves 32 and 14 may be accomplished by any suitable means including, for example, lost-motion connecting means (many forms of which are well known in the art) which may comprise a portion of the linkage or control means 36.

It should also be pointed out that the atomization of the metered fuel brings about, for unit of volume, a substantially less density and thereby such becomes more responsive to variations in engine demands.

Figure 3:
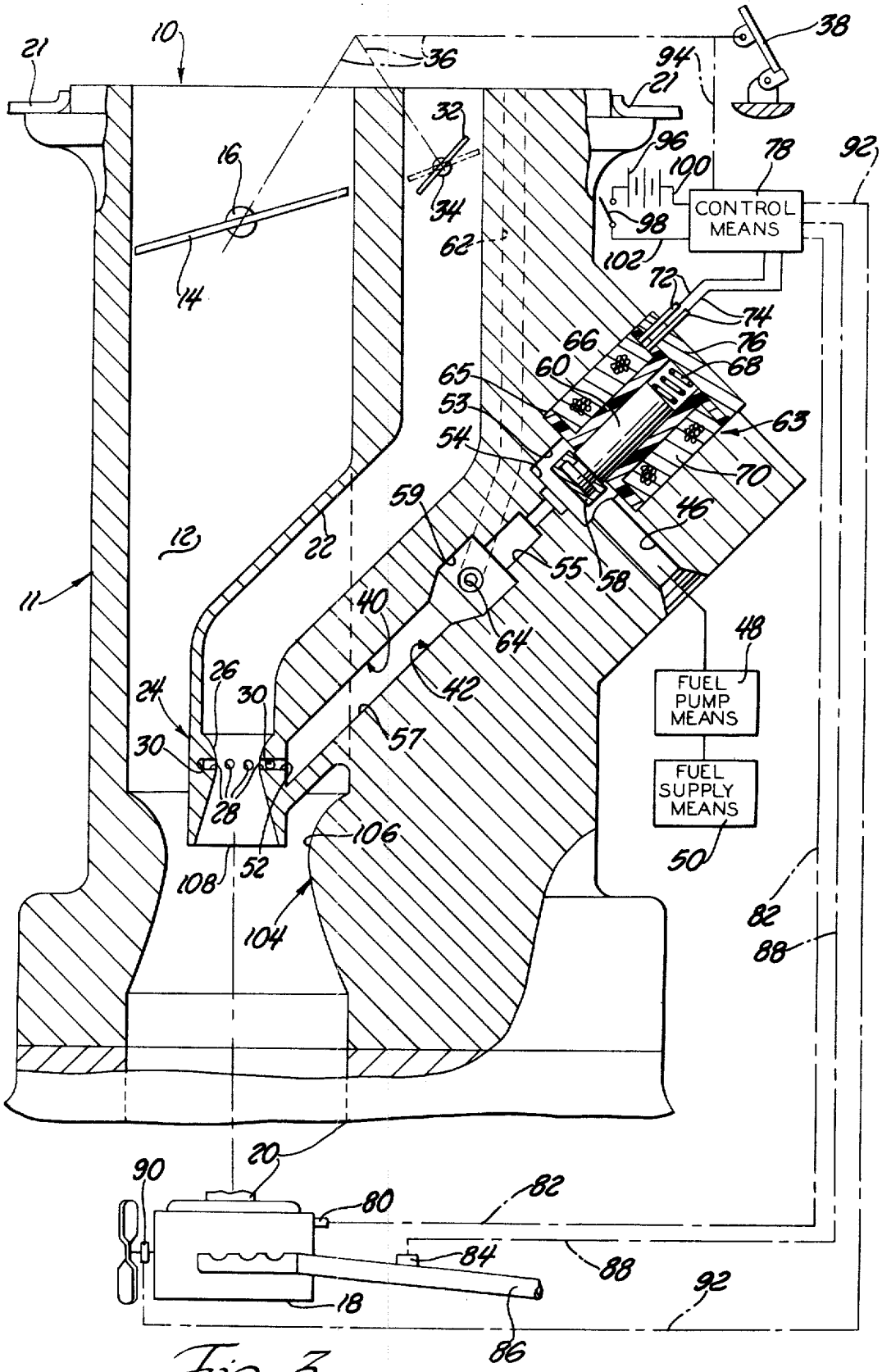
FIG. 3 is a view similar to that of FIG. 1 illustrating what may be considered to be a modification of the apparatus of FIG. 1.

Embodiment of FIG. 3

In FIG. 3 all elements which are like or similar to those of FIGS. 1 and 2 are identified with like reference numbers.

In comparing the apparatus of FIGS. 1 and 2 to that of FIG. 3, it can be seen that the structure of FIG. 3 distinguishes over the embodiment of FIGS. 1 and 2 by the addition of main venturi means 104 in the main induction passage means 12. In the preferred form of the structure of FIG. 3, the outlet end 108 of the discharge nozzle means 24 is situated as to be disposed generally in the throat 106 of venturi means 104.

By employing a secondary venturi 104, it has been discovered that the range of conditions, under which the discharge nozzle 24 experiences sonic flow, is extended. In fact, tests have shown that at wide open throttle conditions sonic velocities are maintained through the primary venturi 26 at engine intake manifold vacuum of less than 4.0 inches of mercury (Hg).

Figure 4:
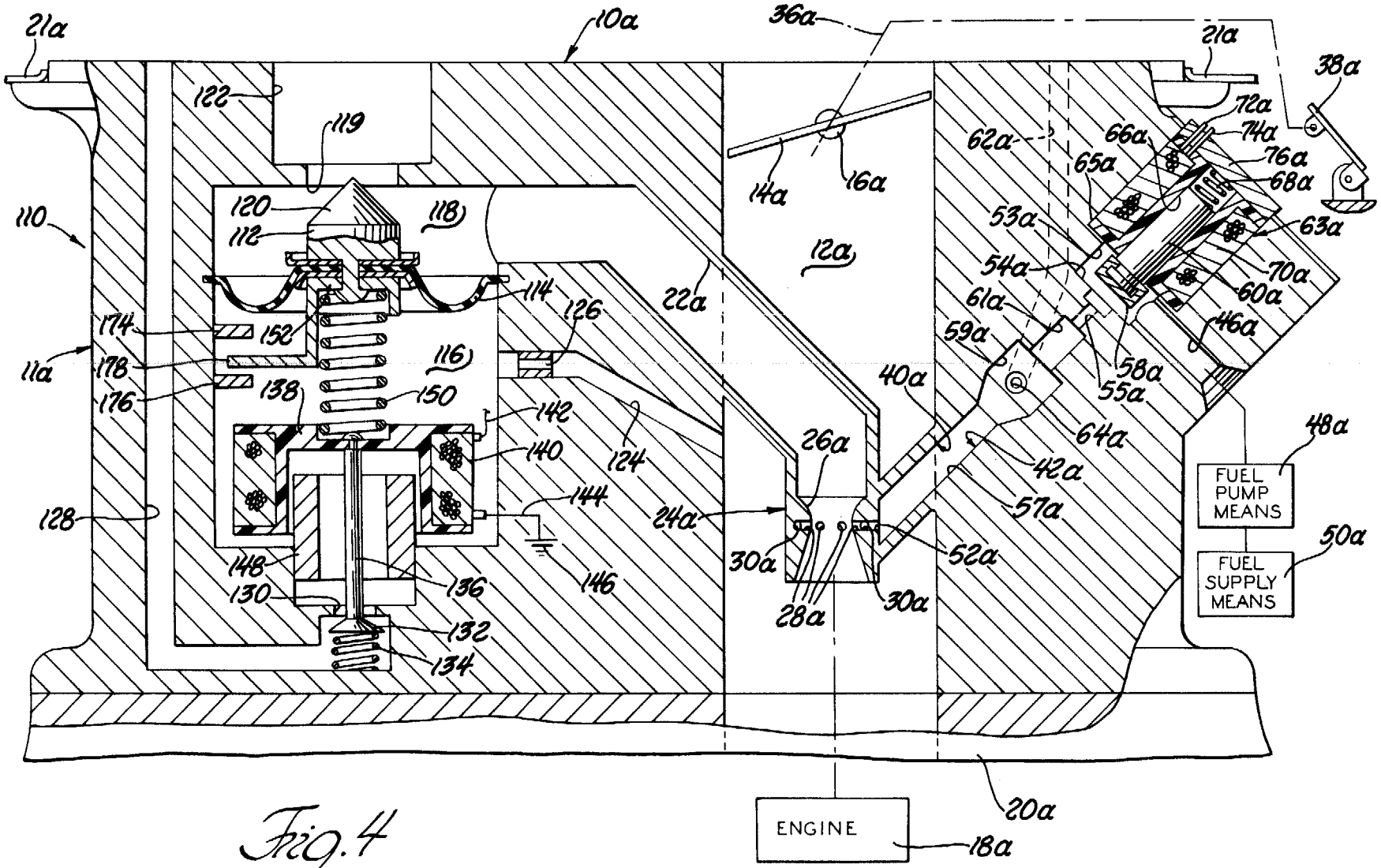
FIG. 4 is a cross-sectional view of another embodiment employing teachings of the invention.

Embodiment of FIG. 4

In FIG. 4 all elements which are like or similar to those of FIGS. 1, 2 and/or FIG. 3 are identified with like reference numbers provided with a suffix "a".

The embodiment as disclosed in FIG. 4 comprises an electro-pneumatic idle speed governor assembly 110 which, in turn, comprises a primary air valve 112 operatively secured as to a pressure responsive movable wall or diaphragm 114 which defines, at opposite sides thereof, a lower disposed chamber area 116 and an upper disposed chamber area 118. Chamber 118 is in communication with and comprises a portion of primary air passage means **22*a*. An orifice 119 cooperates with valve surface 120 of valve member 112 in controlling the rate of air flow from ambient through inlet 122 to chamber 118 and through discharge nozzle means 24*a*. Chamber 116 is, in turn, placed in communication with engine intake manifold vacuum as by conduit means 124 comprising calibrated passage means 126 communicating as with the main induction passage means 12*a* downstream of the main throttle valve means 14*a***.

Chamber 116 is also placed in controlled communication with a source of ambient air as by conduit means 128 and valve orifice means 130 and cooperating valve portion 132 which is resiliently biased in the closing direction as by spring means 134.

Valve portion 132 is illustrated as being operatively connected as through stem means 136 to a bobbin-like structure 138 which carries a field winding or coil 140 provided with suitable electrical leads 142 and 144 with lead 142 being electrically connected as to the related electronic control unit or means **78*b* (FIG. 5) and lead 144 being suitably grounded as schematically depicted at 146. When the winding or coil 140 is energized the field created thereby reacts as against a fixed magnet 148 situated as, for example, generally concentrically within the bobbin structure 138 as to permit the bobbin structure 138 to be axially movable relative thereto. A compression spring 150 is situated generally between and operatively connected to bobbin 138 and a member 152 which is secured to valve member 112** for movement therewith.

Figure 5:
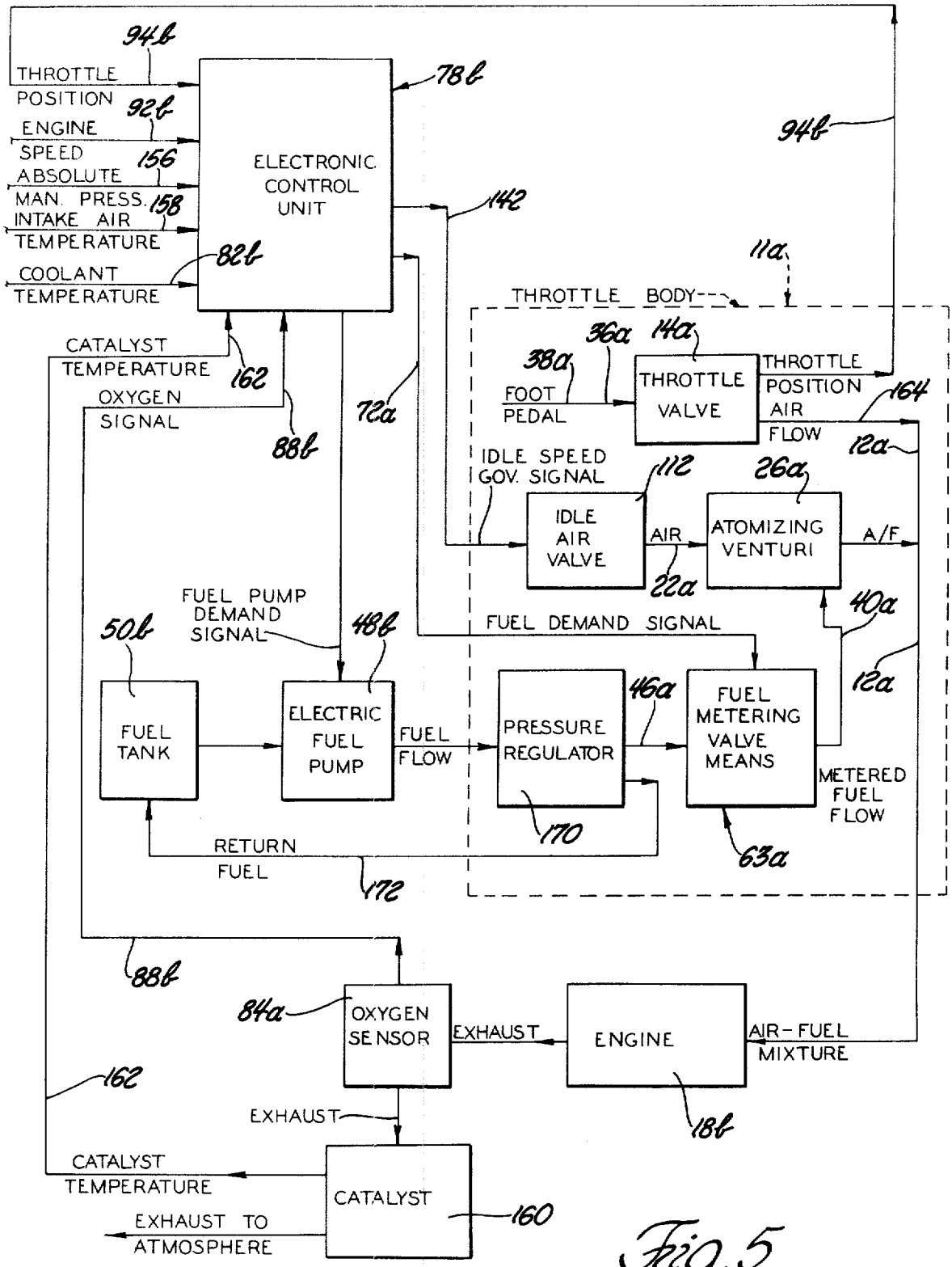
FIG. 5 is a block diagram of an entire fuel metering system as may be applied to or employed in combination with, for example, the embodiment of FIG. 4.

For possibly a better understanding of the operation of the structure of FIG. 4, simultaneous consideration should be given to the diagrammatic illustration of FIG. 5. For ease of reference, elements in FIG. 5 which correspond to the elements of FIG. 4 are identified with like reference numbers and, if any, like suffix while those elements in FIG. 5 which are like or similar to those of FIGS. 1, 2 and/or 3 are identified with like reference numbers provided with a suffix "b".

As generally depicted in FIG. 5, the electronic control or logic means **78*b* is illustrated as receiving input signals, as through suitable transducer means, reflective and indicative of various engine operating parameters and indicia of engine operation. For example, it is contemplated that the electronic logic or control means 78*b* would receive, as inputs, signals of the position of the throttle valve means 14*a* as via transducer or transmission means 94*b*; the magnitude of the engine speed as by transducer or transmission means 92*b*; the magnitude of the absolute pressure within the engine intake manifold 20*a* as by transducer or transmission means 156; the temperature of the air at the inlet of the induction system as by transducer or transmission means 158; the magnitude of the engine 18*b* coolant system temperature as via transducer or transmission means 82*b*; the magnitude of the engine exhaust catalyst 160 temperature as by transducer or transmission means 162; and the percentage of oxygen (or other monitored constituents) in the engine exhaust as by transducer or transmission means 88*b***.

In considering both FIGS. 4 and 5, it can be seen that the electronic control means **78*b*, upon receiving the various input signals, creates a first output signal as along conductor means 142 thereby controllably altering (as will be further explained) the position of primary air valve 112 with respect to orifice means 119 thereby, generally correspondingly, altering the rate of inlet air flow through passage means 22***a* and discharge nozzle means 24*a*. The air thusly flowing through the discharge nozzle 24*a* causes atomization of the metered fuel resulting in a motive fluid of a particular air-fuel ratio which is discharged into the induction passage means 12*a* leading to the engine 18*a*. If the operator should open the main throttle valve means 14*a*, as through pedal 38*a* and linkage or transmission means 36*a*, the new position thereof is conveyed to the control means 78*b* and an additional rate of air flow 164 is permitted into the induction passage means 12*a* as to become commingled with the motive fluid being discharged by the nozzle means 24*a*.

In any event, the fuel-air mixture is introduced into the engine 18*a* (as via intake manifold means 20*a*) and upon being ignited and performing its work is emitted as exhaust. An oxygen sensor, or the like, 84*a* monitors the engine exhaust gases and in accordance therewith creates an output signal via transducer means 88*b* to indicate whether the exhaust gases are overly rich, in terms of fuel, too lean, in terms of fuel, or exactly the proper ratio. The electronic control means, depending upon the nature of the signal received from the oxygen sensor 84*a*, produces an output signal as via conductor means 72*a* for either continuing the same duty cycle of fuel metering valve means 63*a* or altering such as obtain a corrected duty cycle and corresponding altered rate of metered fuel flow. Generally, each of such input signals (varying either singly or collectively) to the electronic control means (except such as will be noted to the contrary) will, in turn, cause the electronic control means 78*b* to produce an appropriate signal to the fuel metering valve assembly 63*a*.

As is also best seen in FIG. 5, a fuel supply or tank 50*b* supplies fuel as to the inlet of an electric fuel pump 48*b* (which may actually be physically located within the fuel tank means 50*b*) which supplies unmetered fuel through suitable pressure regulator means 170. Return conduit means 172 serves to return excess fuel as to the inlet of pump means 48*b* or, as depicted, to the fuel tank means 50*b*. Fuel, still unmetered, at a regulated pressure is delivered via conduit means 46*a* to the upstream side of the effective fuel metering orifice as generally determined by calibrated orifice means 55*a*, stationary valving surface 54*a* coacting valving surface 58*a*.

It is contemplated that certain fuel metering functions can be performed in an open loop manner as a fuel schedule which, in turn, is a function of one or more input signals to the control means 78*b*. For example, it is contemplated that acceleration fuel could be supplied and metered by the fuel metering valving assembly 63*a* as a function of the position of throttle valve means 14*a* and the rate of change of position of such throttle valve means 14*a* while the engine cranking or starting fuel and cold engine operation fuel metering schedule could be a function of engine temperature, engine speed and intake manifold pressure.

Similar to that of FIGS. 1, 2, and 3, the apparatus of FIGS. 4 and 5 provides for idle engine operation by way of idle air induction passage means 22*a* and idle air valving means 112 which, as will be seen, operates in a governor-like mode. More specifically, the valving assembly 110 will operate to maintain engine speed at least equal to a preselected minimum speed during cold idle engine operation and limit the engine speed to not more than a second preselected maximum speed (which may in fact be equal in magnitude to the first mentioned pre-selected minimum speed but more likely be less than said first mentioned preselected minimum speed) during normal or hot idle engine operation. As should be evident, generally, in order to increase idle engine speed a greater rate of idle air flow will have to be accommodated through the induction passage means 22*a* which, in turn, means that the effective flow area of inlet orifice means 119 will have to be relatively increased by the further moving away, therefrom, of valving member 112 and valve surface 120. Similarly, generally, in order to decrease idle engine speed a lesser rate of idle air flow will have to be permitted through the induction passage means 22*a* which, of course, means that the effective flow area of inlet orifice means 119 will have to be relatively decreased by the further movement thereto of valving member 112 and valve surface 120.

Such movement of valve member 112 toward and away from cooperating orifice means 119 is achieved by servo action based on series situated fixed and variable bleedtype orifices. In the embodiment disclosed, calibrated passage or restriction means 126 comprises such fixed orifice means while the variable effective flow area determined by the coaction of orifice means 130 and valving member 132 comprises the variable orifice means.

Generally, as the speed of the engine 18 increases or decreases from a preselected engine set speed in the idle engine range, the control means 78*b* produces a correspondingly changed magnitude of current signal to the winding 140 which, in the case of a decrease in engine speed from the set speed (a negative speed error) causes an increase in the field strength thereof and causing the bobbin structure 138 and winding 140 to move upwardly (as viewed in FIG. 4) due to the reaction of such increased field strength against magnet means 148. As a consequence of such movement by bobbin 138, stem 136 and valve portion 132 are correspondingly moved upwardly thereby resulting in the cooperating orifice means 130 being more nearly closed and, of course, further increasing the restrictive qualities thereof.

With orifice means 130 being more nearly closed, there is a reduced communication from chamber 116, through conduit means 128, to ambient atmosphere. Consequently, the pressure within chamber area 116 decreases (in absolute value) to that more nearly approaching the magnitude of the engine intake manifold absolute pressure (which also exists in induction passages means 12*a* downstream of throttle valve means 14*a*) by virtue of the communication provided by conduit means 124.

As a consequence of the increase in the pressure differential across diaphragm 114, the downward force thereagainst increases causing the diaphragm 114 and valve member 112 to move downwardly (as viewed in FIG. 4) against the resilient resistance of spring means 150 thereby increasing the effective flow area as between coacting orifice means 119 and valve surface 120. The increased effective flow area permits an increase in idle air flow through passage means 22*a* and discharge nozzle 24*a* resulting in an increase of engine speed thereby bringing the engine speed to the preselected set speed.

In the case of an increase in engine speed from the set speed (a positive speed error) the control means 78*b* causes a reduction in the field strength of winding 140 thereby resulting in bobbin structure 138 and winding moving downwardly (as viewed in FIG. 4) due to the reduced reaction of such reduced field strength against magnet means 148. As a consequence of such movement by bobbin 138, stem 136 and valve portion 132 are correspondingly moved downwardly thereby resulting in the cooperating orifice means 130 being more nearly fully opened and, of course, further reducing the restrictive qualities thereof.

With orifice means 130 being more nearly fully opened, there is increased communication from chamber 116, through conduit means 128, to ambient atmosphere. Consequently, the pressure within chamber area 116 increases (in absolute valve) to that more nearly approaching the magnitude of ambient. Because of the change in pressure differential across the diaphragm 114, the downward force thereagainst is decreased enabling diaphragm 114 and valve member 112 to move upwardly (as viewed in FIG. 4) thereby decreasing the effective flow area as between coacting orifice means 119 and valve surface 120. The decreased effective flow area decreases the rate of idle air flow through passage means 22*a* and discharge nozzle 24*a* resulting in a decrease of engine speed thereby bringing the engine speed to the preselected set speed. It should be mentioned that the current employed to thusly energize the solenoid winding 140 may actually be positive or negative, that is, flowing in opposite directions depending on whether the sensed actual engine speed is, for example, greater or less than the then set speed.

In the apparatus of FIG. 4, it would be preferred to have the preselected engine set speed biased by the magnitudes of the signals indicative of engine coolant temperature so that, for example, during cold engine starting and operation the biased engine set speed is greater than the engine set speed upon the engine subsequently attaining normal engine operating temperature.

As should now be apparent, the idle governing means 110 provides for valve travel, of valve 112, as a function of spring rate and solenoid (winding 140) force. Consequently, the advantages of such an arrangement are that the travel of valve 112 is independent of the travel of solenoid 138,140 and the forces for moving valve 112 are independent of solenoid force levels.

By way of general summary of the apparatus of FIGS. 4 and 5, all metered fuel is introduced into a sonic flow venturi discharge nozzle 24*a*. The sonic venturi nozzle discharges the atomized fuel and idle air flow into the engine intake manifold pressure at a point downstream of the main throttle valve means 14*a*. Bleed air is introduced into the already metered fuel (metered by the fuel metering valving means 63*a*) in a manner as described with reference to FIGS. 1 and 2, thereby further increasing the velocity of such metered fuel and causing atomization of the fuel on its way to the sonic discharge nozzle means 24*a* as well as serving to eliminate or minimize the effect of fuel vaporization in the metered fuel conduit means 42*a*. As a consequence of the increased velocity of the low pressure metered fuel, a separate acceleration fuel orifice is not necessary. That is, the acceleration fuel function may be accomplished in the control means 78*a* by sensing the rate of change of position of throttle valve means 14*a* and, in response thereto, increasing the rate of metered fuel flow by an increasing of the rate of metered fuel flow by an increasing the percentage of open time of orifice means 54*a* for a span of time generally proportional to the change in throttle 14*a* position.

Further, the provision of bleed air into the metered fuel has the additional advantage of stretching-out any possible fuel pulsations, created as at the orifice means 55*a* by the oscillating or reciprocating movement of valve member 60*a*, and thereby make the fuel flow rate at the throat of sonic venturi 26*a* become, for all practical purposes, a continuous rate as opposed to an intermittent rate. Further, by employing the invention, it becomes possible to employ very low pressure fuel pump means since the invention in no way employs fuel pressure for any part of the fuel atomization.

In the arrangement of FIGS. 4 and 5, the open loop metering functions schedule metered fuel flow as a function of engine speed, engine inlet manifold pressure and temperature. Such a schedule, for cold engine starting and cold engine operation, is preferably biased as a function of engine coolant temperature. Further, it is contemplated that open loop scheduling of metered fuel flow could be employed during catalytic converter warm-up and for maximum engine power as at wide open throttle conditions as well as being employed during and under any other conditions considered necessary or desirable.

Engine idle speed governing is accomplished by modulating the amount of idle air flow while fuel flow is metered either as a function of engine speed and engine inlet manifold absolute pressure on an open loop basis or on the closed loop feedback principle. Generally, the idle speed governor means has a limited range of authority that will go from minimum idle speed requirements to maximum idle speed requirements. In this connection, as generally depicted at 174 and 176 of FIG. 4 positive stop means or members are fixedly secured and placed in the path of travel of a movable abutment member 178 operatively secured to valve member 112 for movement therewith. Stop or abutment means 174 serves to limit the travel of abutment member 178 and valve member 112 toward orifice means 119 and therefore establish an absolute minimum idle engine speed while stop or abutment means 176 serves to limit the travel of abutment member 178 and valve member 112 away from orifice means 119 and therefore establish an absolute maximum idle engine speed. Obviously, with such an arrangement, the governor or air valve 112 becomes fail safe in both directions enabling the associated vehicle to be driven even with a failed governor.

The governor means 110 is a proportional plus integral type of governor operated on the engine speed error signal between sensed actual engine speed and preselected engine set speed with such being computed in and by the control means 78*b*. Preferably, such set speed is biased as a function of engine coolant temperature as between extremes of normal engine idle and fast engine idle. The output signal from the control means 78*b* is electrical current to the solenoid coil 140. The electrical current being proportional to the said speed error signal results in the solenoid generating a force proportional to current. A null type servo 132 operatively connected to the movable coil or winding 140, generates a vacuum, in chamber 116, that is a percentage of engine intake manifold vacuum as by two orifices in series. The forces thusly developed are sufficient to move the air valve 112 against the force of the feedback spring means 150. As previously indicated, the advantages are that valve travel of valve 112 is independent of solenoid travel and valve 112 force levels or magnitudes are independent of solenoid force levels at magnitudes.

The fuel atomization in the induction passage is excellent at idle engine speed because the nozzle venturi 26*a* flows at sonic conditions at idle operation and the sonic air velocities at the metered fuel entrance cause excellent distribution of the atomized fuel.

The venturi 26a air velocities are very high even at wide open throttle condition of throttle valve means 14a because the full available inlet manifold vacuum is employed to accelerate the air in the venturi 26a. In this connection it should be specifically pointed out that it is further contemplated that an additional venturi similar to that at 104 of FIG. 3 may be similarly situated in induction passage means 12a of FIG. 4 as to have even higher venturi velocities at reduced magnitudes of intake manifold vacuums and cause discharge of such metered fuel from nozzle means 24a into such additional venturi as generally depicted in and described with reference to FIG. 3.

Further, by way of summary and with reference to the embodiments of FIGS. 1, 2 and 3, it should be made clear that the embodiments of FIGS. 1, 2 and 3 exhibit the same benefits as described with reference to FIGS. 4 and 5 and that the similarly identified elements cooperate and perform in a manner described, possibly in greater detail, with respect to the embodiment of FIGS. 4 and 5. In particular, the benefits of sonic flow discharge nozzle means and bleed air, obviously, are realized in the practice of the invention disclosed in the structures of FIGS. 1, 2 and 3. Also, in the structures of FIGS. 1, 2 and 3, it is contemplated that suitable temperature responsive means may be operatively connected to idle air valve means 32 in order to provide for fast idle engine operation (as during cold engine starting and operation) and normal idle engine operation (as when the engine attains normal engine operating temperature).

Further, either or both of the structures of FIGS. 1, 2 and 3 may be operated within an overall philosophy of operation as described with reference to the embodiment of FIG. 4 and as diagrammatically illustrated in FIG. 5. However, it should be made clear that the practice of the invention is not limited to the employment of an overall system and philosophy of operation as specifically described by and with reference to FIG. 5.

The invention as disclosed in FIGS. 1, 3 and 4 depicts the metered fuel passage means 40 as being straight though inclined. It should be made clear that the invention can be practiced equally well with such metered fuel passage means 40 being horizontally disposed as with respect to, for example, the discharge port means 28.

Although only a preferred embodiment of the invention and selected forms of practice thereof have been disclosed and described, it is apparent that other embodiments and modifications of the invention are possible within the scope of the invention.

What is claimed is:

1. Fuel metering apparatus for supplying metered rates of fuel flow to a combustion engine, comprising body means, induction passage means formed through said body means for supplying motive fluid to said engine, said induction passage means comprising primary induction passage means and main induction passage means, said main induction passage means comprising first inlet means for permitting the inlet of air and first outlet means for discharging motive fluid to said engine, main throttle valve means for variably controlling the rate of flow of air into said first inlet means and through said main induction passage means, said primary induction passage means comprising second inlet means for permitting the inlet of air and second outlet means for discharging motive fluid to said engine, primary throttle valve means for variably controlling the flow of air through said primary induction passage means, said second outlet means comprising sonic venturi discharge nozzle means situated generally in said main induction passage means downstream of said main throttle valve means, fuel metering means for metering liquid fuel in response to engine demands and indicia of engine operation, metered fuel conduit means communicating between said fuel metering means and said sonic venturi discharge nozzle means, and air bleed means communicating between a source of air and said metered fuel conduit means for bleeding air into such liquid fuel as is metered by said fuel metering means as to cause atomization of said metered liquid fuel for delivery to said discharge nozzle means, said air bleed means being situated with respect to said metered fuel conduit means as to cause said bleed air to have a flow path generally perpendicular to the path of flow of said metered liquid fuel flowing in said metered fuel conduit means thereby causing said bleed air to strike said metered liquid fuel at an attitude generally perpendicular thereto and thereby change said metered liquid fuel to atomized metered fuel, said air bleed means comprising calibrated air passage means, and said calibrated air passage means being effective to flow said bleed air therethrough at sonic flow during normal engine operating conditions.

2. Fuel metering apparatus according to claim 1 wherein said metered fuel conduit means defines a generally straight-line flow path from said fuel metering means to said sonic venturi discharge nozzle means.

3. Fuel metering apparatus according to claim 1 wherein said metered fuel conduit means comprises a generally straight conduit section, wherein said generally straight conduit section comprises a serially situated generally enlarged chamber-like portion, and wherein said air bleed means in communicating with said metered fuel conduit means communicates with said enlarged chamber-like portion.

4. Fuel metering apparatus according to claim 3 wherein said calibrated air passage means comprises a downstream exit end, and wherein said exit end terminates in at least close proximity to the interior of said enlarged chamber-like portion.

5. Fuel metering apparatus according to claim 1 wherein said metered fuel conduit means is relatively inclined with respect to said sonic venturi discharge nozzle means as to have an upstream portion of said metered fuel conduit means at an elevation higher than a downstream portion thereof.

6. Fuel metering apparatus according to claim 1 and further comprising means responsive to the speed of said engine becoming less than a preselected minimum speed for causing said primary throttle valve means to be moved toward a more nearly fully opened position.

7. Fuel metering apparatus according to claim 1 and further comprising means responsive to the speed of said engine becoming greater than a preselected maximum speed for causing said primary throttle valve means to be moved toward a more nearly fully closed position.

8. Fuel metering apparatus according to claim 1 and further comprising means responsive to the speed of said engine becoming less than a preselected minimum speed for causing said primary throttle valve means to be moved toward a more nearly fully opened position and responsive to the speed of said engine becoming greater than a preselected maximum speed for causing said primary throttle valve means to be moved toward a more nearly fully closed position.

9. Fuel metering apparatus according to claim 6 wherein said means responsive to the speed of said engine comprises electro-pneumatic governor means, said governor means comprising pressure responsive movable wall means operatively connected to said primary throttle valve means, a fluid pressure chamber at one side of said movable wall means as to cause said one side of said movable wall means to be exposed to the magnitude of the fluid pressure within said fluid pressure chamber, a source of actuating fluid pressure, conduit means for communicating said actuating fluid pressure to said fluid pressure chamber, valving means for variably restricting the degree of said communication of said actuating fluid pressure to said fluid pressure chamber, and solenoid motor means operatively connected to said valving means for variably opening said valving means, said solenoid motor means being energized in response to indicia of said speed of said engine.

10. Fuel metering apparatus according to claim 7 wherein said means responsive to the speed of said engine comprises electro-pneumatic governor means, said governor means comprising pressure responsive movable wall means operatively connected to said primary throttle valve means, a fluid pressure chamber at one side of said movable wall means as to cause said one side of said movable wall means to be exposed to the magnitude of the fluid pressure within said fluid pressure chamber, a source of actuating fluid pressure, conduit means for communicating said actuating fluid pressure to said fluid pressure chamber, valving means for variably restricting the degree of said communication of said actuating fluid pressure to said fluid pressure chamber, and solenoid motor means operatively connected to said valving means for variably opening said valving means, said solenoid motor means being energized in response to indicia of said speed of said engine.

11. Fuel metering apparatus according to claim 8 wherein said means responsive to the speed of said engine comprises electro-pneumatic governor means, said governor means comprising pressure responsive movable wall means operatively connected to said primary throttle valve means, a fluid pressure chamber at one side of said movable wall means as to cause said one side of said movable wall means to be exposed to the magnitude of the fluid pressure within said fluid pressure chamber, a source of actuating fluid pressure, conduit means for communicating said actuating fluid pressure to said fluid pressure chamber, valving means for variably restricting the degree of said communication of said actuating fluid pressure to said fluid pressure chamber, and solenoid motor means operatively connected to said valving means for variably opening said valving means, said solenoid motor means being energized in response to indicia of said speed of said engine.

12. Fuel metering apparatus according to claim 9 and further comprising spring means operatively interconnecting said solenoid motor means and said movable wall means.

13. Fuel metering apparatus according to claim 9 wherein said movable wall means comprises pressure responsive movable diaphragm means.

14. Fuel metering apparatus according to claim 9 and further comprising stop means, said stop means being effective to establish a maximum degree to which said primary throttle valve means may move toward a more nearly fully closed position.

15. Fuel metering apparatus according to claim 9 and further comprising stop means, said stop means being effective to establish a maximum degree to which said primary throttle valve means may move toward a more nearly fully opened position.

16. Fuel metering apparatus according to claim 9 and further comprising first stop means effective to establish a maximum degree to which said primary throttle valve means may move toward a more nearly fully closed position, and second stop means effective to establish a maximum degree to which said primary throttle valve means may move toward a more nearly fully opened position.

17. Fuel metering apparatus according to claim 9 and further comprising calibrated passage means communicating between said fluid pressure chamber and a source of relatively low magnitude fluid pressure, and wherein the magnitude of said fluid pressure within said fluid pressure chamber is a function of the rate of pressure loss incurred through said calibrated passage means and the pressure increase accommodated through said conduit means from said source of actuating fluid pressure.

18. Fuel metering apparatus according to claim 9 wherein said solenoid motor means comprises an electrically energizable field winding, and wherein said field winding is operatively connected to said valving means for movement therewith.

19. Fuel metering apparatus according to claim 17 wherein said source of relatively low magnitude fluid pressure comprises intake vacuum generated by said engine.

20. Fuel metering apparatus according to claim 10 and further comprising spring means operatively interconnecting said solenoid motor means and said movable wall means.

21. Fuel metering apparatus according to claim 10 wherein said movable wall means comprises pressure responsive movable diaphragm means.

22. Fuel metering apparatus according to claim 10 and further comprising stop means, said stop means being effective to establish a maximum degree to which said primary throttle valve means may move toward a more nearly fully closed position.

23. Fuel metering apparatus according to claim 10 and further comprising stop means, said stop means being effective to establish a maximum degree to which said primary throttle valve means may move toward a more nearly fully opened position.

24. Fuel metering apparatus according to claim 10 and further comprising first stop means effective to establish a maximum degree to which said primary throttle valve means may move toward a more nearly fully closed position, and second stop means effective to establish a maximum degree to which said primary throttle valve means may move toward a more nearly fully opened position.

25. Fuel metering apparatus according to claim 10 and further comprising calibrated passage means communicating between said fluid pressure chamber and a source of relatively low magnitude fluid pressure, and wherein the magnitude of said fluid pressure within said fluid pressure chamber is a function of the rate of pressure loss incurred through said calibrated passage means and the pressure increase accommodated through said conduit means from said source of actuating fluid pressure.

26. Fuel metering apparatus according to claim 10 wherein said solenoid motor means comprises an electrically energizable field winding, and wherein said field winding is operatively connected to said valving means for movement therewith.

27. Fuel metering apparatus according to claim 25 wherein said source of relatively low magnitude fluid pressure comprises intake vacuum generated by said engine.

28. Fuel metering apparatus according to claim 11 and further comprising spring means operatively interconnecting said solenoid motor means and said movable wall means.

29. Fuel metering apparatus according to claim 11 wherein said movable wall means comprises pressure responsive movable diaphragm means.

30. Fuel metering apparatus according to claim 11 and further comprising stop means, said stop means being effective to establish a maximum degree to which said primary throttle valve means may move toward a more nearly fully closed position.

31. Fuel metering apparatus according to claim 11 and further comprising stop means, said stop means being effective to establish a maximum degree to which said primary throttle valve means may move toward a more nearly fully opened position.

32. Fuel metering apparatus according to claim 11 and further comprising first stop means effective to establish a maximum degree to which said primary throttle valve means may move toward a more nearly fully closed position, and second stop means effective to establish a maximum degree to which said primary throttle valve means may move toward a more nearly fully opened position.

33. Fuel metering apparatus according to claim 11 and further comprising calibrated passage means communicating between said fluid pressure chamber and a source of relatively low magnitude fluid pressure, and wherein the magnitude of said fluid pressure within said fluid pressure chamber is a function of the rate of pressure loss incurred through said calibrated passage means and the pressure increase accommodated through said conduit means from said source of actuating fluid pressure.

34. Fuel metering apparatus according to claim 11 wherein said solenoid motor means comprises an electrically energizable field winding, and wherein said field winding is operatively connected to said valving means for movement therewith.

35. Fuel metering apparatus according to claim 33 wherein said source of relatively low magnitude fluid pressure comprises intake vacuum generated by said engine.

36. Fuel metering apparatus according to claim 17 wherein said source of relatively low magnitude fluid pressure comprises said main induction passage means downstream of said main throttle valve means.

37. Fuel metering apparatus according to claim 25 wherein said source of relatively low magnitude fluid pressure comprises said main induction passage means downstream of said main throttle valve means.

38. Fuel metering apparatus according to claim 33 wherein said source of relatively low magnitude fluid pressure comprises said main induction passage means downstream of said main throttle valve means.

39. Fuel metering apparatus according to claim 1 wherein said fuel metering means for metering liquid fuel comprises a duty-cycle type metering solenoid assembly, wherein said metering solenoid assembly comprises a metering valve acting as armature means of said metering solenoid assembly, and a field winding, said field winding being intermittently energizable during metering of said liquid fuel as to cause said metering valve to move toward and away from a closed position and thereby result in an average rate of flow of fuel therepast which constitutes the then metered rate of liquid fuel flow.

40. Fuel metering apparatus according to claim 39 and further comprising engine idle speed governor means operatively connected to said primary throttle valve means, said governor means being responsive to engine speeds deviating from a preselected set speed whereby as engine speed tends to increase beyond said set speed said governor means causes said primary throttle valve means to move in a closing direction and whereby as engine speed tends to decrease beyond said set speed said governor means causes said primary throttle valve means to move in an opening direction.

41. Fuel metering apparatus according to claim 40 and further comprising means responsive to engine temperature and effective for changing the magnitude of said set speed in response to said engine temperature so that the magnitude of said set speed is greater at engine temperatures less than normal engine operating temperature.

42. Fuel metering apparatus according to claim 1 and further comprising engine idle speed governor means operatively connected to said primary throttle valve means, said governor means being responsive to engine speeds deviating from a preselected set speed whereby as engine speed tends to increase beyond said set speed said governor means causes said primary throttle valve means to move in a closing direction and whereby as engine speed tends to decrease beyond said set speed said governor means causes said primary throttle valve means to move in an opening direction.

43. Fuel metering apparatus according to claim 42 and further comprising means responsive to engine temperature and effective for changing the magnitude of said set speed in response to said engine temperature so that the magnitude of said set speed is relatively greater when the engine temperature is relatively low and so that the magnitude of said set speed is relatively lower when the engine temperature is at a preselected relatively higher normal engine operating temperature.

44. Fuel metering apparatus according to claim 1 and further comprising engine idle speed governor means operatively connected to said primary throttle valve means, said governor means being effective to at times cause said primary throttle valve means to move in a closing direction and at other times cause said primary throttle valve means to move in an opening direction, electronic logic and control means, engine exhaust gas passage means, engine exhaust gas catalyst means, oxygen sensor means for sensing the relative presence of oxygen in said exhaust gas and applying a first input signal indicative thereof to said logic and control means, first transducer means for sensing the temperature of said engine and applying a second input signal indicative thereof to said logic and control means, second transducer means for sensing the temperature of said catalyst and applying a third input signal indicative thereof to said logic and control means, third transducer means for sensing the degree of opening of said main throttle valve means and applying a fourth input signal indicative thereof to said logic and control means, fourth transducer means for sensing the speed of said engine and applying a fifth input signal indicative thereof to said logic and control means, fifth means for applying a sixth input signal indicative of the pressure within said main induction passage means to said logic and control means, sixth means for applying a seventh input signal indicative of the temperature of the air being admitted into said main induction passage means to said logic and control means, said logic and control means being effective to in response to said first second third fourth fifth sixth and seventh input signals produce and apply a first control output signal to said governor means to indicate whether the speed of the engine is greater or less than a preselected set idle speed and produce and apply a second control output signal to said fuel metering means to indicate the then desired rate of liquid fuel to be metered.

45. Fuel metering apparatus according to claim 1 and further comprising second venturi means carried within said main induction passage means, said second venturi means being situated downstream of said main throttle valve means, and said sonic venturi discharge nozzle means being situated generally in the vicinity of the throat of said second venturi means as to discharge said atomized metered fuel into said second venturi means.

46. Fuel metering apparatus according to claim 1 wherein said primary throttle valve means is pressure responsive and positionable in response to a sensed pressure differential thereacross.

47. Fuel metering apparatus according to claim 1 wherein said primary throttle valve means is pivotally rotatable within said primary induction passage means.

48. Fuel metering apparatus according to claim 46 wherein said pressure differential is of a magnitude reflective of engine load.

49. Fuel metering apparatus according to claim 1 and further comprising electro-pneumatic actuating means operatively connected to said primary throttle valve means.

* * * * *